US007067019B1

(12) United States Patent
Fedchun et al.

(10) Patent No.: US 7,067,019 B1
(45) Date of Patent: Jun. 27, 2006

(54) ALLOY STEEL AND ARTICLE MADE THEREFROM

(75) Inventors: Vladimir A. Fedchun, Farmington Hills, MI (US); Mark Razdolsky, West Bloomfield, MI (US)

(73) Assignee: Malltech, L.L.C., Wixom, MI (US)

( * ) Notice: Subject to any disclaimer, the term of this patent is extended or adjusted under 35 U.S.C. 154(b) by 103 days.

(21) Appl. No.: 10/719,046

(22) Filed: Nov. 24, 2003

(51) Int. Cl.
*C22C 38/42* (2006.01)
*C22C 38/46* (2006.01)

(52) U.S. Cl. ..... 148/333; 148/332; 148/319; 148/318; 420/91; 420/112

(58) Field of Classification Search ..... 148/319, 148/318, 332, 317; 420/109, 91, 90
See application file for complete search history.

(56) References Cited

U.S. PATENT DOCUMENTS 3,713,905 A * 1/1973 Philip et al. ..... 148/319
6,699,333 B1 * 3/2004 Dubois ..... 148/319

OTHER PUBLICATIONS

ASM International, Materials Park, Ohio, Metallographer's Guide: Practices and Procedures for Irons and Steels, Chapter 1, "Introduction to Steels and Cast Irons", Table1.1 p. 3, 1999.*

* cited by examiner

*Primary Examiner*—Deborah Yee
(74) *Attorney, Agent, or Firm*—Alex Rhodes

(57) ABSTRACT

A relatively high strength high toughness medium Carbon Copper-Nickel-Chromium alloy steel and method that eliminates and/or reduces the use of scarce, expensive alloying elements and is lower in cost than existing high strength high toughness alloy steels with comparable strength and toughness properties. In a first embodiment, the alloy steel is comprised of by weight about 0.40–1.00% Copper, about 2.50–8.00% Nickel, and about 0.80–3.50% Chromium. In a second embodiment the alloy steel is comprised of by weight about 0.55–0.70% Copper, about 1.0–6.0% Nickel, and about 1.0–2.2% Chromium.

6 Claims, No Drawings

ALLOY STEEL AND ARTICLE MADE THEREFROM

The invention herein described was made in the course of or under a contract or subcontract thereunder, with the Department of the Air Force.

FIELD OF THE INVENTION

This invention relates to alloy steels and more particularly to a relatively low cost high strength high toughness Copper-Nickel-Chromium (Cu/Ni/Cr) alloy steel and an article made therefrom.

BACKGROUND OF THE INVENTION

AF 1410 (U.S. Pat. No. 4,076,525) and AirMet 100® (U.S. Pat. No. 5,087,415) are exemplary of alloy steels (Group A herein), sometimes referred to as superalloys, which combine very high strength and high toughness. One drawback of these alloy steels is their very high cost, because their superior mechanical properties are achieved through the use of scarce and costly alloying elements such as cobalt, nickel and molybdenum, and complex processing, namely double vacuum remelting, aging, refrigeration (Table 3). Their high prices and poor machinability limit their applications to mainly military and aerospace products.

U.S. Pat. No. 3,713,905 and U.S. Pat. No. 6,187,261 are exemplary of high strength steels such as grades AISI 4340 and 300M moderately priced alloy steels (Group B herein). They use traditional chemistries to provide high ultimate and yield strengths after thermal processing, but lack the high toughness of the first (Group A) described alloys.

Typical lower priced martensitic alloy steels (Group C herein) as described in U.S. Pat. No. 5,180,450 provide good toughness but lack the high ultimate and yield strengths of the Group A and B alloy steels.

The use of the Group A ultra high strength and high toughness alloy steels is limited because of their prices. Engineers must select from a large numbers of steel alloys to meet either strength or toughness design requirements and cost objectives. This practice causes high steel making and inventory costs and a need for large amounts of scarce high cost alloying elements. Moderately priced steels combining high strength and high toughness (as Group A) with good machinability and heat treatment properties (as Group B) would have substantial economic value and advance the art of alloy steels.

SUMMARY OF THE INVENTION

The present invention is a relatively low cost high strength high toughness medium Carbon Copper-Nickel-Chromium alloy steel. A primary object of the invention is to provide a lower cost alternative to current high cost Group A Alloy Steels. A still further object of the invention, in addition to the forgoing object is to provide a competitive cost alternative with significantly higher toughness than the Group B Alloy Steels. A still further object, in addition to the foregoing objects, is to reduce the use of scarce alloying elements such as Cobalt. A still further object in addition to the foregoing objects is to expand the use of high strength high toughness alloy steels.

In a first embodiment of the invention, a medium carbon lower cost alternative is provided to the high cost Grade A alloy steels comprising by weight about 0.40–1.00% Copper, about 2.50–8.00% Nickel, and about 0.80–3.50% Chromium.

In a second embodiment of the invention, a high toughness alternative is provided to the Grade B alloy steels comprising by weight about 0.55–0.70% Copper, about 1.0–6.0% Nickel, and about 1.0–2.2% Chromium.

Additional features and benefits will be apparent by reference to the ensuing detailed descriptions of preferred embodiments which discloses the best mode contemplated in carrying out the invention. The property in which exclusive rights are claimed is set forth in the numbered claims following the detailed description of the preferred embodiment.

DETAILED DESCRIPTION OF THE INVENTION

The present invention is the result of a development of cost effective alloy steels, realized through considering the effects of alloying elements and their costs on strength and toughness properties of alloy steels. Selections of suitable alloying elements and their concentrations took into account the known atomic structures of the elements; the solid solubilities of the elements in alpha-iron; the capabilities of the elements to modify the electron structures of solid solutions in the alpha-iron lattice, and the adsorption activities of alloying elements with respect to the interfaces of metal systems. Another important consideration was the ability of developmental alloys to respond effectively to surface strengthening by carburizing and nitriding.

Table 1 is a summary of alloys tested, their chemical composition (alloys 1–20) and mechanical properties (alloys 1–18).

Table 2 shows properties of alloy 19 subjected to carburizing and alloy 20 subjected to nitriding.

Table 3 shows comparison of mechanical properties and costs of alloying elements of known Group A and Group B target alloys, and several alloys according to present invention (Examples 1, 5, 8 from Table 1).

Specific ratios of Silicon/Copper (Si/Cu), Carbon/Vanadium (C/V) and C+V/Nickel (Ni) were applied to modify and control the diffusion mechanisms of interstitial elements (C, N, O, H) for reducing the probability of brittle phases forming on the grain and phase boundaries during tempering and for modifying and controlling the kinetics of phase and structural transformations during heating and cooling.

The high adsorption activity of Copper in alpha-iron caused Copper atoms to quickly migrate toward grain and phase boundaries during tempering. Copper together with Silicon formed solid solution zones with low ion potentials, precluding carbide and nitride phases from forming in boundary areas. Copper also improved mechanical properties such as yield to tensile strength ratios, ductility, impact resistance, machinability and corrosion resistance. Copper was determined to be best used in an alloy steel in a ratio of Si to Cu of approximately 1.0–2.5. Concentrations of copper over 1.0% wt. Cu were detrimental to an alloy's toughness because of the formation of epsilon-phase (solid solution of Fe in Cu) on the boundaries of martensite crystals after quenching and tempering. Relatively high amounts of copper in alloy steels as exemplified by U.S. Pat. No. 3,713,905 results in relatively low toughness.

Nickel (Ni) in the present invention is the primary contributor to high toughness. Nickel increases the electron density of the alpha-iron based solid solution, transforming alpha-iron lattice into a symmetrical and therefore, a more ductile alpha-iron lattice due to a reduced sharing of covalent bonds. While additions of Ni within a claimed range, for any given level of Carbon within the claimed range, had relatively little effect on the alloy's hardness and ultimate strength after quenching and tempering, the yield strength significantly decreased. At the low end of a claimed carbon range (about 0.22–0.30%) adding Ni in an amount over 3.5–4.0% was counterproductive in terms of an alloy's cost, since same yield and toughness properties could be achieved by simply reducing the level of C in the alloy.

At the high end of a claimed carbon range (0.50–0.55% C), nickel in amounts over 3.5–4.0% adversely affected both ultimate and yield strength. Up to 8.0% Ni can be used in the mid-carbon range of this alloy (0.30–0.45% C) to obtain high toughness and, preferably, up to 6.0% Ni to obtain optimum combination of strength and toughness.

Chromium (Cr) increased strength, hardenability and temper resistance. In the preferred composition when alloys were subjected to nitriding or carbo-nitriding, Cr was responsible for forming high hardness zones of fine dispersed CrN clusters, coherent with alpha-iron matrix. When the chromium content in the steel exceeded 3.5% wt., alloy's ductile properties were adversely affected in the tempering temperature range of 180° C.–650° C.

Silicon (Si)—in the selected ranges strengthened the steel matrix by increasing the share of covalent bonding between atoms in a solid solution. The strengthening effect is also due to its effect on the dislocating formations at intercrystalline and phase boundaries, leading to polygonization of Si-reach areas which provides additional channels for diffusion of carbon during tempering, carburizing and nitriding.

It was determined that the positive effect of Silicon on mechanical properties of the subject steel starts at a silicon concentration of 0.5% wt. Silicon concentrations of over 1.5% wt. caused undesirable carbide and nitride phases to form in the grain boundaries. Silicon in the interval of 0.5 to 1.5% wt. in a steel alloy contributed to improved hardenability and temper resistance, and reduced the transformation temperature from the viscous to the brittle state. Silicon also produces some negative effects on the properties of steel, for example, by causing significant grain growth during long heat cycles, such as annealing. These effects are suppressed in the invention by copper and vanadium.

Vanadium (V) affected the structure and properties of the steel in several ways. First, by forming in austenite fine dispersed particles of carbides, nitrides and carbo-nitrides, which controlled the size and shape of grains and then, consequently, the size of the ferrite grains after "gamma-alpha" transformations. This in turn, affected the strength and ductility of the steel. Second, by precipitating vanadium based, fine dispersed secondary carbides and carbo-nitrides during quenching and tempering, the vanadium deterred re-crystallization of ferrite and promoted formation in the ferrite of a very fine equi-axial grain. Third, by influencing the kinetics and morphology of the "gamma-alpha prime" transformation products during quenching and tempering. By forming fine dispersed carbides and carbo-nitrides in the austenite grain body, vanadium promoted formation of fine massive martensite, which provided the alloy with good combination of strength and ductility properties after quenching.

Titanium (Ti) in the present compositions acts in similar way as vanadium. Our studies showed that alloy cost can be further reduced by substituting Ti, despite its poorer than vanadium solubility in iron. Ti is a more active carbide and nitride forming element than vanadium, being at the same time less expensive as pure metal and ferroalloy.

The medium carbon (C) embodiment required contents in excess of 0.2% C to meet strength requirements. The principal strengthening mechanism was the tempering of the carbon martensites, which produced a precipitation of carbide particles generally detrimental to high toughness. As carbon alone was increased there was an increased tendency for microcracking due to increased lattice strains present as a result of higher tetragonal distortion. This condition was alleviated by adding substantial amounts of solid strengtheners, e.g. Ni, Mn which reduced the level of carbon necessary to attain high strength. The strength/toughness properties were best balanced in the range of 0.35–0.45% wt C.

Manganese (Mn) in the present composition is somewhat higher than is usual in steels of this type. Mn was necessary as a deoxidizer in the steel making process and, in addition, it is a strong contributor to hardenability. If less than 0.50% wt. was present, the effects of elimination of hot shortness due to manganese sulfide formation and improvement in machinability was not be attained to the necessary degree. If above 1.50% wt Mn. was present, it promoted retention of austenite and the strength of the alloy was adversely affected.

Sulfur (S) improved machinability by facilitating chip breakage. However sulfur above 0.045% wt S was detrimental to physical properties such as ductility and impact strength. Despite these drawbacks however sulfur served the useful function of improving machinability.

Phosphorus (P)—also aided machinability by facilitating chip breakage. However phosphorus above 0.025 was detrimental to physical properties such as ductility and impact strength following mid and high tempering (660–1200° F.). Strength and toughness of low tempered martensite (300–400° F.) were little influenced by P content of up to 0.15% wt.

Sample alloys were produced in an open air 100 lb induction furnace and cast into cylindrical 4.0" diameter graphite molds. Liquid metal was poured from 2920+/−20° F. 50 lb ingots were subjected to homogenizing annealing at 1725° F. for 9 hours; then cooled within the furnace to 935° F., then cooled in air to room temperature. Thereafter ingots were heated to 2110° F. and rolled or forged to a final size of approximately 1" diameter. Finished bars were further annealed for 9 hrs at 1210° F., Standard ASTM tensile bars and impact V-notch (Charpy) test samples were machined and heat treated. Alloy compositions, quenching and tempering temperatures, and mechanical properties are shown in Table 1.

An optimum combination of strength and toughness was obtained with alloys containing 0.35–0.45% carbon and 2.5–6.0% nickel, after quenching from 1580–1625° F. (after 1 hour soak time) in a salt bath (or oil quenched, or air cooled) and subsequent tempering at 350–400° F. for 5–6 hours. Subsequent refrigeration somewhat increased the level of yield strength (Table 1).

Alloys according to the invention having compositions within the ranges of: carbon 0.22–0.32 wt. %, copper 0.40–1.00 wt. %, chromium 0.80–1.25 wt. %, nickel 1.00–3.50 wt. %, can be effectively strengthened (case hardened) by carburizing and nitro-carburizing.

Tensile and Charpy V-notch samples from the present alloy comprising by weight 0.28% C, 0.93% Mn, 1.04% Cr, 0.97% Si, 0.56% Cu, 3.25% Ni and 0.35% V were carburized for 9 hrs at 1724° F. Samples were normalized at 1625° F. and tempered for 6 hours at 1210° F., then quenched from 1544° F. in oil and tempered for 6 hours at 350° F. The mechanical properties obtained from these samples are presented in Table 2.

Several alloy samples according to the invention of the same composition were through-carburized to a carbon concentration of 0.65 wt. % in the sample cross-section and tested for fracture toughness with results presented in Table 2.

Alloys according to the invention in the range of concentrations: carbon 0.33–0.55 wt. %, copper 0.40–1.00 wt. %, chromium 1.20–3.50 wt. %, nickel 1.00–3.50 wt. %, can be effectively strengthened by low temperature nitriding.

Tensile and Charpy V-notch samples from an alloy comprising by weight 0.42% C, 0.87% Mn, 2.04% Cr, 1.02% Si, 0.55% Cu, 2.13% Ni and 0.35% V were quenched from 1625° F. and tempered for 6 hours at 1040° F., then nitrided in ion nitriding furnace for 24 hrs at 932° F. Mechanical properties obtained from these samples are presented in Table 2.

Although only several embodiments have been described, it is not our intention to limit the scope of our invention to the disclosed embodiments since other embodiments can be derived from what is claimed by changes that are obvious to persons skilled in the art without departing from spirit thereof.

TABLE 1

| EXAMPLE | CHEMICAL COMPOSITION | | | | | | | MECHANICAL PROPERTIES | | | | | |
|---|---|---|---|---|---|---|---|---|---|---|---|---|---|
| | | | | | | | | | UTS | YS | Elong. | R.A. | KCV |
| No | Ni | C | Mn | Si | Cr | Cu | V | HRC | ksi | ksi | % | % | ft-lbs |
| 1 | 1.64 | 0.37 | 0.91 | 0.94 | 1.11 | 0.55 | 0.37 | 54 | 290 | 225 | 12.0 | 37.0 | 29 |
| 2 | 2.46 | 0.45 | 0.96 | 1.13 | 1.31 | 0.53 | 0.26 | 54 | 301 | 238 | 13.8 | 47.8 | 31 |
| 3 | 2.46 | 0.51 | 1.07 | 1.26 | 1.2 | 0.53 | 0.25 | 55 | 328 | 232 | 11.2 | 27.4 | 23 |
| 4 | 2.48 | 0.42 | 1.14 | 1.23 | 1.23 | 0.53 | 0.25 | 55 | 301 | 235 | 12.0 | 31.2 | 31 |
| 5 | 2.52 | 0.4 | 1.17 | 1.19 | 1.21 | 0.53 | 0.25 | 53 | 297 | 232 | 12.6 | 33.9 | 33 |
| 6 | 3.74 | 0.38 | 0.83 | 1.01 | 2.02 | 0.52 | 0.34 | 53 | 278 | 211 | 14.3 | 40.3 | 25 |
| 7 | 4.13 | 0.36 | 0.86 | 0.89 | 1.08 | 0.54 | 0.37 | 52 | 279 | 219 | 12.5 | 42.0 | 36 |
| 8 | 4.29 | 0.39 | 0.84 | 0.76 | 1.25 | 0.68 | 0.25 | 54 | 287 | 242 | 14.2 | 47.9 | 30 |
| 9 | 4.42 | 0.42 | 1.19 | 1.31 | 1.21 | 0.53 | 0.25 | 53 | 298 | 226 | 13.8 | 41.0 | 31 |
| 10 | 4.43 | 0.37 | 0.76 | 1.06 | 1.2 | 0.53 | 0.25 | 52 | 272 | 219 | 14.8 | 54.1 | 42 |
| 11 | 4.44 | 0.51 | 0.96 | 1.13 | 1.15 | 0.52 | 0.25 | 54 | 313 | 218 | 13.7 | 44.2 | 28 |
| 12 | 4.47 | 0.45 | 0.88 | 1.05 | 1.14 | 0.52 | 0.25 | 52 | 300 | 218 | 13.9 | 44.4 | 30 |
| 13 | 5.47 | 0.38 | 0.81 | 0.93 | 1.86 | 0.53 | 0.93 | 50 | 256 | 200 | 13.3 | 41.8 | 26 |
| 14 | 5.96 | 0.38 | 0.65 | 0.78 | 1.22 | 0.67 | 0.24 | 53 | 281 | 235 | 14.5 | 49.8 | 32 |
| 15 | 6.84 | 0.39 | 1.21 | 1.44 | 1.21 | 0.52 | 0.25 | 50 | 270 | 190 | 15.0 | 39.0 | 34 |
| 16 | 6.84 | 0.43 | 1.18 | 1.3 | 1.21 | 0.53 | 0.24 | 51 | 289 | 198 | 16.2 | 42.3 | 29 |
| 17 | 6.91 | 0.46 | 0.88 | 0.96 | 1.17 | 0.52 | 0.23 | 51 | 291 | 189 | 15.1 | 40.2 | 24 |
| 18 | 6.97 | 0.51 | 0.68 | 0.88 | 1.1 | 0.53 | 0.24 | 52 | 303 | 175 | 14.1 | 31.7 | 23 |
| 19 | 3.25 | 0.28 | 0.93 | 0.97 | 1.04 | 0.56 | 0.35 | | | | | | |
| 20 | 2.13 | 0.42 | 0.87 | 1.02 | 2.04 | 0.55 | 0.35 | | | | | | |

TABLE 2

| EXAMPLE | TERMO-CHEMICAL | CASE DEPTH | HARDNESS | | UTS | YS | Elng | R.A. | KCV | Fracture Toughness |
|---|---|---|---|---|---|---|---|---|---|---|
| No | TREATMENT | IN (MM) | Surface | Core | ksi | ksi | % | % | ft-lbs | ksi$\sqrt{in}$ |
| 19 | Carburizing: 1724 F./9 Hrs<br>Quenching: 1545° F.<br>Temper: 350° F./5 Hrs | 0.07 (1.8) | HRC 59 | HRC 45 | 241 | 232 | 8.4 | 26.9 | 13.2 | |
| | Carburizing: 1724 F./60 Hrs<br>Quenching: 1545° F.<br>Temper: 350° F./5 Hrs | Through | HRC 59 | HRC 59 | | | | | | 48, 52, 54 |
| 20 | Quenching: 1625° F.<br>Temper: 1040° F./3 Hrs<br>Ion Nitriding: 935° F./24 Hrs | 0.022 (0.55) | HV 1202 ksi | HRC 42 | 198 | 185 | 11 | 29.4 | 17.6 | |

TABLE 3

| | STEEL GRADE | CHEMICAL COMPOSITION | HEAT TREATMENT | MECHANICAL CHARACTERISTICS | | | | | | CHARGE MATERIAL |
|---|---|---|---|---|---|---|---|---|---|---|
| | | | | HRC | UTS ksi | YS ksi | Elong. % | R.A. % | KCV ft-lbs | COST $/Lb * |
| Group "A" | AF 1410 | C-0.19; Cr-2.00; Ni-10.0; Co-14.0; Mo-1.00 | Quench. 1625° F. Refrig. −100° F. Aged 900° F. | 52 | 254 | 224 | 16 | 69 | 48 | 1.83 |
| | AirMet 100 | C-0.25; Cr-3.10; Ni-10.0; Co-13.5; Mo-1.20 | Quench. 1625° F. Refrig. −100° F. Aged 900° F. | 54 | 285 | 250 | 14 | 65 | 30 | 1.82 |
| | Example 8 Table 1 | C-0.39; Mn-0.84; Si-0.76; Cr-1.25; Ni-4.29; Cu-0.68 V-0.25 | Quench. 1625° F. Temper. 350° F. | 54 | 287 | 242 | 14.2 | 47.9 | 30 | 0.21 |

TABLE 3-continued

| | STEEL GRADE | CHEMICAL COMPOSITION | HEAT TREATMENT | MECHANICAL CHARACTERISTICS HRC | UTS ksi | YS ksi | Elong. % | R.A. % | KCV ft-lbs | CHARGE MATERIAL COST $/Lb * |
|---|---|---|---|---|---|---|---|---|---|---|
| Group "B" | AISI 4340 | C-0.43; Mn-0.80; Si-0.30; Cr-0.90; Ni-2.0; Mo-0.30 | Quench. 1580° F. Temper. 400° F. | 53 | 270 | 225 | 12 | 40 | 21 | 0.13 |
| | 300M | C-0.40; Mn-0.75; Si-1.60; Cr-0.85; Ni-1.85; Mo-0.4 V-0.10 | Quench. 1685° F. Temper. 400° F. | 54 | 289 | 245 | 9 | 34 | 22 | 0.15 |
| | U.S. Pat. No. 3,713,905 Example 5 | C-0.40; Mn-0.21; Si-0.98; Cr-1.07; Ni-3.04; Mo-0.71 Cu-2.00; V-0.12 | Quench. 1525° F. Temper. 300° F. | 54.5 | 309 | 207 | 8.7 | 27.8 | 11 | 0.24 |
| | Example 1 Table 1 | C-0.37; Mn-0.91; Si-0.94; Cr-1.11; Ni-1.64; Cu-0.55; V-0.37 | Quench. 1625° F. Temper. 350° F. | 54 | 290 | 225 | 12 | 37 | 29 | 0.11 |
| | Example 5 Table 1 | C-0.40; Mn-1.17; Si-1.19; Cr-1.21; Ni-2.52; Cu-0.53; V-0.25 | Quench. 1625° F. Temper. 350° F. | 53 | 297 | 232 | 12.6 | 33.9 | 33 | 0.14 |

* - approximate charge cost for each alloy based on average 2002–2003 LME prices

We claim:

1. A deep hardening Cu/Ni/Cr alloy steel for reducing the cost of high toughness, high strength steels, by eliminating the use of the scarce high cost alloying elements cobalt and molybdenum comprising by weight: about 0.22–0.55% carbon, about 0.40–1.0% copper; about 0.80–3.5% of chromium; about 2.5–8.0% nickel; about 0.55–1.50% of silicon, said silicon and said copper being present in a Si to Cu weight ratio of about 1.2–2.5; about 0.15–1.50% manganese; at least one transitional element from the group consisting of vanadium in about 0.10–1.00% by weight and titanium in about 0.10–0.65% by weight; Co and Mo eliminated as alloying constituents; and the remainder iron and incidental impurities.

2. A deep hardening Cu/Ni/Cr alloy steel for reducing the cost of high toughness, high strength steels by eliminating the use of the scarce high cost alloying elements cobalt and molybdenum comprising about 0.40–0.65% by weight of copper; about 0.75–1.50% by weight of silicon, said copper and said silicon being present in a Si to Cu weight ratio of about 1.2–2.5%; about 1.50–3.50% by weight of chromium; about 1.0–6.0% by weight of nickel; about 0.35–0.50% by weight of carbon before and after deep hardening; about 0.50–1.50% by weight of manganese; at least one transitional element from the group consisting of vanadium in about 0.10–1.00% by weight and titanium in about 0.10–0.65% by weight; Co and Mo eliminated as alloying constituents; and the remainder iron and incidental impurities.

3. A deep hardening Cu/Ni/Cr alloy steel for reducing the cost of high toughness high strength steels by eliminating the use of the scarce high cost alloying elements cobalt and molybdenum comprising by weight about 0.22 to 0.55% C, about 0.4 to 1.0% Cu, about 2.5 to 8.0% of Ni, about 0.8 to 3.5% Cr, about 0.50 to 1.5% Si, said copper and said silicon being present in a Si to Cu weight ratio of about 1.2–2.5; about 0.50 to 1.50% Mn; at least one transitional, element from the group consisting of vanadium in about 0.10–1.00% by weight Co and Mo eliminated as alloying constituents; and titanium in about 0.10–0.65% by weight; the remainder iron and incidental impurities; and characterized by the presence of retained austenite after quenching form an austenitizing temperature, said steel having a microstructure comprised of a major phase of lath martensite enveloped by a minor phase of retained austenite.

4. A low cost rolled or forged article of high toughness, high strength Cu/Ni/Cr alloy deep hardening steel having after quenching and tempering an HRC hardness of at least 50, a yield strength of at least 200 ksi and an impact strength value 14-eV KCV of at least 28 ft-lb, and consisting essentially of by weight: about 0.50–0.70% of copper; about 0.80–3.50% of chromium; about 2.0–8.0% nickel; about 0.35–0.50% carbon; about 0.75–1.50% silicon, said copper and said silicon being present in a Si to Cu weight ratio of about 1.2–2.5; about 0.65–1.20% manganese; at least one transitional element from the group consisting of vanadium in about 0.10–1.00% by weight and titanium in about 0.10–0.65% by weight; Co and Mo eliminated as alloying constituents; and the remainder iron and incidental impurities.

5. An article manufactured from a low cost, high toughness, high strength Cu/Ni/Cr alloy steel without the scarce high cost alloying elements cobalt and molybdenum consisting by weight essentially of: about 0.32–0.55% carbon, about 0.50–1.00% of silicon; about 0.40–1.0% copper, said copper and said silicon being present in a silicon to copper weight ratio of about 1.2–2.5; about 0.80–3.5% of chromium; about 1.0–3.5% nickel; about 0.50–1.00% manganese; at least one transitional element from the group of elements: 0.10–1.0% of vanadium, 0.10–0.65% titanium; Co and Mo eliminated as alloying constituents; and the remainder iron and incidental impurities and having after nitriding an exceptionally deep and hard outer case and high core strength and toughness.

6. A rolled or forged article made from a low cost high toughness, high strength, Cu/Ni/Cr deep hardening alloy steel without the scarce high cost alloying elements cobalt and molybdenum consisting essentially by weight of about 0.35 to 0.50% carbon; about 0.4 to 1.0% Cu, about 2.0 to 8.0% of Ni, about 0.8 to 3.5% Cr, about 0.50 to 1.5% Si, said copper and said silicon being present in a Si to Cu weight ratio of about 1.2–2.5; at least one transitional element from a group consisting of vanadium in about 0.10–1.0% by weight and titanium in about 0.10–0.65% by weight, Co and Mo eliminated as alloying constituents; the remainder iron and incidental impurities and characterized by the presence of retained austenite after quenching from an austenitizing temperature, said steel having a microstructure comprised of a major phase of lath martensite enveloped by a minor phase of retained austenite and a hardness of at least HRC 50, a yield strength of at least about 200 ksi and a Charpy impact value KCV of about at least 28 ft-lb.

* * * * *